US006279282B1

(12) United States Patent
Krionidis

(10) Patent No.: US 6,279,282 B1
(45) Date of Patent: Aug. 28, 2001

(54) SCREED

(76) Inventor: Michael Krionidis, 18554 Strathern St., Reseda, CA (US) 91335

( * ) Notice: Subject to any disclaimer, the term of this patent is extended or adjusted under 35 U.S.C. 154(b) by 0 days.

(21) Appl. No.: 09/359,722

(22) Filed: Jul. 23, 1999

(51) Int. Cl.[7] ..... E04F 13/06
(52) U.S. Cl. ..... 52/365
(58) Field of Search ..... 52/364, 342, 343, 52/365, 371

(56) References Cited

U.S. PATENT DOCUMENTS

| | | | | |
|---|---|---|---|---|
| 1,568,375 | * | 1/1926 | Gillett | 52/365 |
| 2,197,278 | * | 4/1940 | Sverdahl | 52/365 |
| 2,990,652 | * | 7/1961 | Santoro | 52/365 |
| 3,127,703 | * | 4/1964 | Eshelman | 52/365 |
| 4,360,993 | * | 11/1982 | Tomokazu et al. | 52/365 |
| 4,945,698 | * | 8/1990 | Jertberg et al. | 52/365 |

* cited by examiner

*Primary Examiner*—David M. Purol
(74) *Attorney, Agent, or Firm*—Frank L. Zugelter

(57) ABSTRACT

A screed device (41, 42) formed by an elongated straight rigid member (54) that includes a pair of spaced threading assemblies (62) extending through member (54) between its rounded front side (47) and its back side (57). Each assembly (62) includes a screw (63) with a tapering neck (66), a head (64) for turning the screw (63), and a threading screw portion (67) projecting beyond the back side (57), along with a pair of bushings (71, 72) disposed within member (54) and in which the tapered neck (66) rotates, providing for the threading screw portion (67) to thread to a stud (22, 23, 24). The inner bushing (71) attaches to the tapering neck (66), to provide a cylindrical outer surface (75) that engages a cylindrical inner surface (76) on bushing (72) that is attached to member (54). Levels (78) are included in one wall (55, 56) of member (54). In practice, a pair of screed devices (41) are threaded to their respective studs (22, 23, 24) spaced apart from one another, and levels (78) are used to truly plumb the devices (54) in order that a finish coat (44) of the wall product itself is aligned within a true plumb.

14 Claims, 5 Drawing Sheets

SCREED

TECHNICAL FILED

This invention relates generally to the construction of wall product and ceiling structures, and in particular to a screed that provides a truly planar surface, in vertical and horizontal and other orientations, for the constructed wall product that is formed.

BACKGROUND TO THE INVENTOIN

In a traditional method of plastering a wall product, ceiling, or floor, without the placing of tiles on the wall product thereafter, wooden float strips are used to guide a straight edge across an area forming the wall product being plastered, while raking off excess mud, etc., left in the application of the mud. The float strips, or "screeds" are tapped into the prepared or wet mud, such as mortar, cement, or other suitable materials, with a separate level held against one or more of them to obtain a horizontal, vertical, or other orientation or plum. The float strips, straight edge, and the board carrying the mud itself, are usually wet before use so that they won't draw moisture out of the prepared mud. It is important that the float strips themselves are straight and plumbed as much as possible, for the purpose of keeping the finished wall product or ceiling surfaces as straight as possible, however, a true planar wall surface is not generated with the traditional tools, and much is left up to the individual craftsman or novice.

BACKGROUND ART

Prior art known to the inventor is found in the following U.S. Pat. Nos. 1,762,254; 2,025,576; 3,494,090; 3,841,046; 4,073,593; 4,785,601; 4,945,698; 5,363,619; and 5,630,297. Also, the book "Ceramic Tile Setting" authored by John P. Bridge, published by TAB Books, a Division of McGraw-Hill, Inc. (1992).

SUMMARY OF THE INVENTION

The invention is embraced within an article, referred to herein at times as a screed device, and in a method of its use for constructing a wall product and its planar surface, formed of coatings or layers of plaster, mortar, cement, or a combination of these or other suitable construction materials. The screed device is an elongated member in which spaced freely rotatable screws extend through the entirety or thickness of the member, for affixing to a stud forming the skeleton or framing of a wall, ceiling, or the like, and to which tar paper, lath, and wet mud are applied. A pair of bushings or linings, one outside the other, are mounted about and circumscribe the neck of each screw which nevertheless is free to rotate within the outer bushing. The inner bushing is affixed to the neck of the screw while the outer bushing is affixed to the member. A lock washer is mounted in an annular groove in the neck of the screw, abutting a back side or surface of the member, and retains the freely rotatable screw within and throughout the thickness of the member.

In the application of a pair of screed devices, as applied in the formation of a wall product, after tar paper and its lath have been mounted and affixed to adjoining spaced studs (not necessarily immediately next to one another), the screws of each of a pair of them are threaded to its corresponding stud, and each of the devices is plumbed true, vertically or horizontally, by an included level or by another level applied to the screed device. The noted coatings are applied to the apron of the lath and the tar paper, between the adjoining studs, to a depth measured to the front surface of or to points or lines of tangencies with the screeds which have been plumbed true and which are held secure to their studs by the screws. A straight edge is utilized to remove excess mud that has been applied between the screeds to form the wall product. The finish surface of the constructed wall product is truly plumbed, whether it be in a finished vertically-oriented, horizontally-oriented, or other oriented wall product or in a finished ceiling wall product.

An object of this invention is to provide a novel screed device.

Another object of this invention is to provide truly plumbed surfaces of a wall product, ceiling, or floor.

A yet further object of the invention is to reduce in a significant fashion the amount of time consumed in constructing a wall product, vis-a-vis traditional or conventional ways and time taken to do so with conventional or known screeds.

A still further object of the invention is to provide a considerable savings in the amount of time required to form a wall product or ceiling with the device of this invention, thus reducing the laborious effort with its time to build the wall product or ceiling, which heretofore has been more extensive than in the case with this inventive device.

Another object of this invention is to provide a competitive position for doing the work because of the application of the device of this invention compared to the labor and cost involved using a conventional or known screed.

Yet a further object of the invention is to reduce the cost of construction of a wall product or ceiling produced by the utilization of screed devices.

These and other objects and advantages of the invention will become more apparent by a full and complete reading of the following description, the appended claims thereto, and the accompanying drawing comprising five (5) sheets of eleven (11) Figures.

PREFERRED MODE OF CARRYING OUT THE INVENTION

Figure 1:
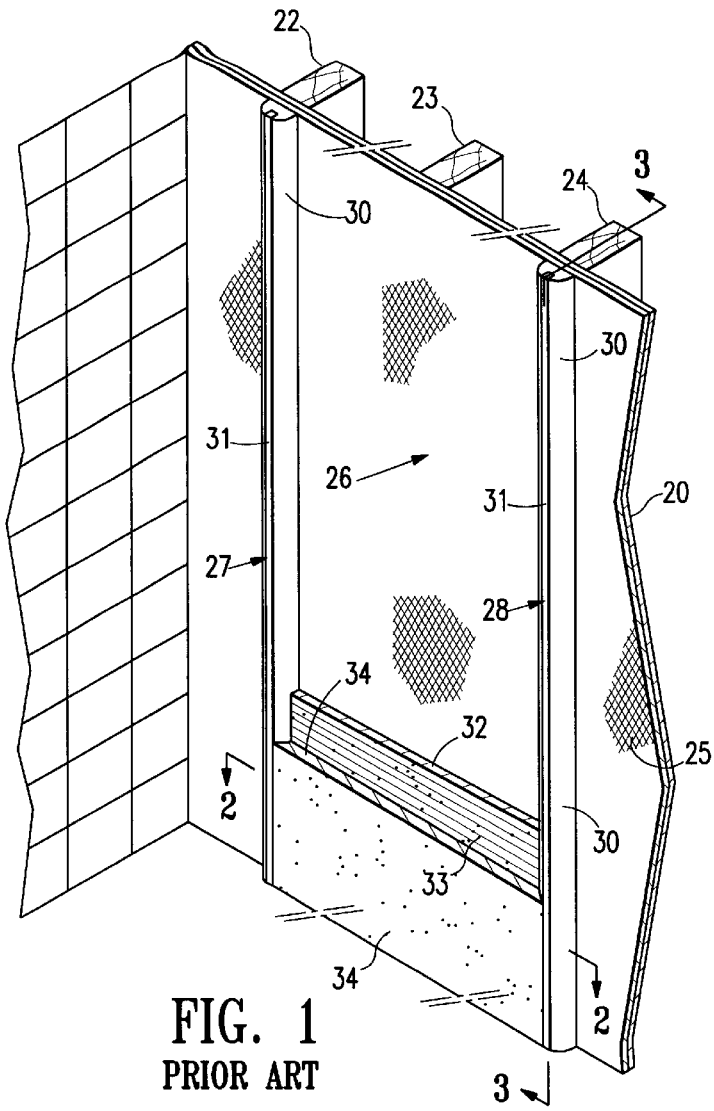
FIG. 1 PRIOR ART
FIG. 1 is a perspective view of conventional or prior art screeds applied in the construction of a wall product.
Figure 3:
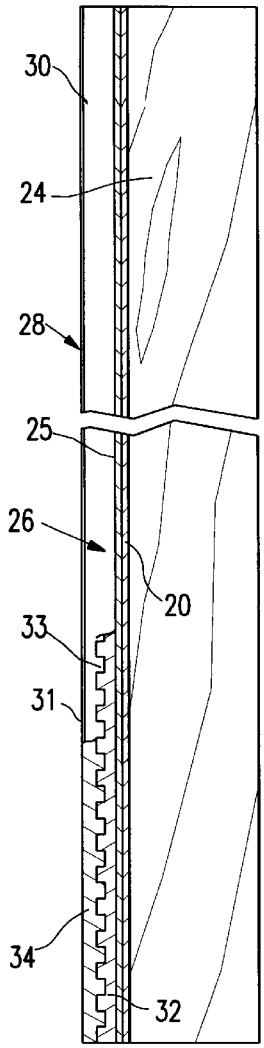
FIG. 3 PRIOR ART
FIG. 3 is a view taken on line 3—3 of FIG. 1.
Figure 2:
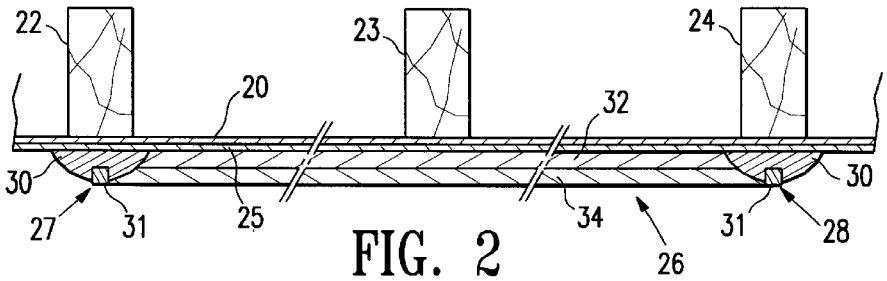
FIG. 2 PRIOR ART
FIG. 2 is a view taken on line 2—2 of FIG. 1, but modified over FIG. 1.

Preliminary to understanding the invention, FIGS. 1, 2, and 3 provide illustrations of prior art devices and practices utilizing conventional screeds or tools (and methods therewith) that have been used in the past to construct a wall product formed from one or more of the noted coatings. In FIG. 1, tar paper 20 is shown to be affixed to a series of vertically-oriented spaced static structures or studs 22, 23, 24, and to which metal lath 25 has been applied across an apron 26 of space between studs and suitably affixed to the studs, such as by staples for the tar paper and nails for the lath. In order for the conventional screeds 27, 28 to be mounted to their positions, columns 30 of mud first are vertically applied to the lath's apron 26, as shown in these FIGURES in order for the conventional screeds 27, 28 to be mounted to their positions,. Each of these columns 30 is generated by applying a series of loads of wet mud, each load in an upwardly moving manner, with one on top of the other, from one stud across to the next or to an adjoining one (for e.g., were three (3) columns of mud were spacedly applied), to thereby form the columns 30 of mud shown in these FIGURES. Thereafter screeds 27, 28 are introduced, as shown, into each column 30 which is of a wet state for ease of introduction. These screeds 27, 28 essentially are formed from rectangular pieces of material, such as wood, with their surfaces 31 flush against the columns 30, FIG. 2. It should be noted that columns 30 are hand-crafted by a plasterer and are not exact duplicates of one another, varying to some extent primarily in width and depth one to the next. Surfaces 31 of the screeds determine the thickness of the wall product and its finished surface. The wall product thus can be of different thicknesses between studs. With the columns 30 of wet mud and screeds 27, 28 deposited in their positions in such columns 30, a first or scratch coat 32 of wet mud is applied or laid to the apron 26 of lath 25, between the columns 30 of wet mud. Usually, grooves 33 are included in coat 32, resulting from the use of the plasterer's grooved trowel (not shown) in applying coat 32, to assist in the adherence of a second or finish coat 34 to the first coat. After the scratch coat 32 drys, the second or finish coat 33, such as cement, then is applied or set to the apron 26 of the dried scratch coat 32 and against columns 30 of dried mud, to the extent or depth of the exposed surfaces 31 of the screeds. There is no assurance that the wall's surface is deliberately determined to lie within a plane 37, FIG. 5, that has been plumbed and which is achieved in the operation of this invention, whether or not a waviness in the apron space across which the tar paper and lath between studs is disposed. It may be noted that the studs themselves are not necessarily statically positioned in a true vertical (or horizontal or other orientation) orientation and which non-true-orientation lends itself to the production of a wall not truly plumbed. Screeds 27, 28 then are removed or pulled from their respective sockets formed in the mud, and the finish coat 33 is applied to the voids that remain in the sockets' lengths. The finish coat 33 then is allowed to dry thereby forming the finished wall product.

Figure 4:
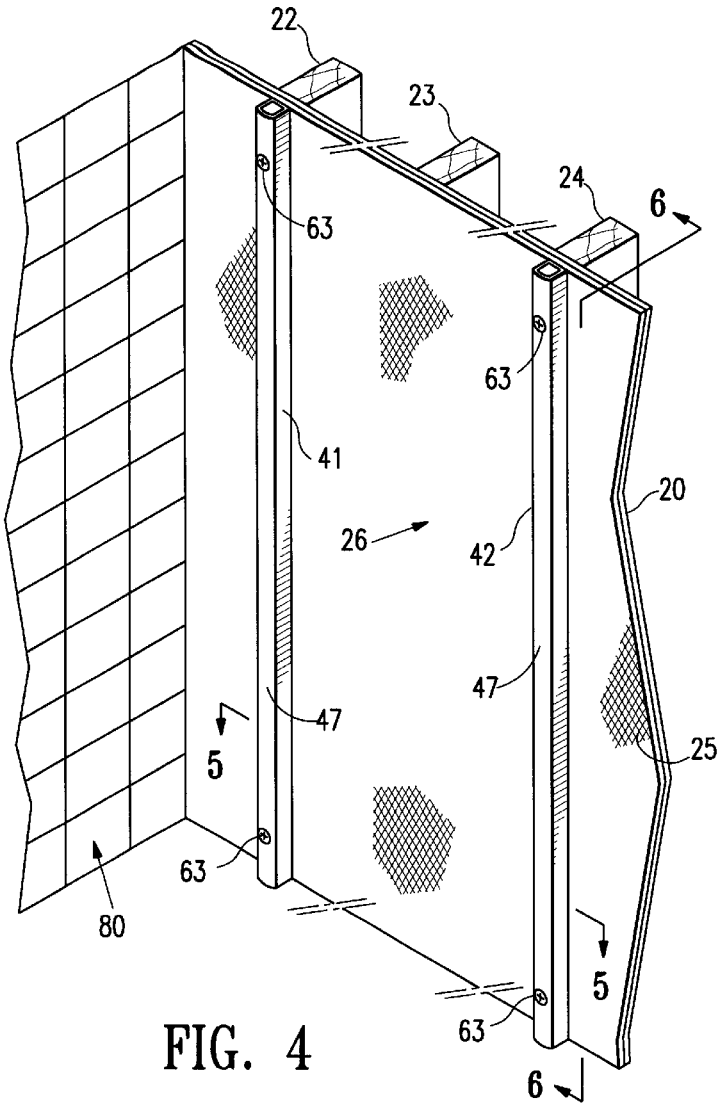
FIG. 4 is a perspective view of devices embodying this invention and as applied in the construction of a wall product.
Figure 6:
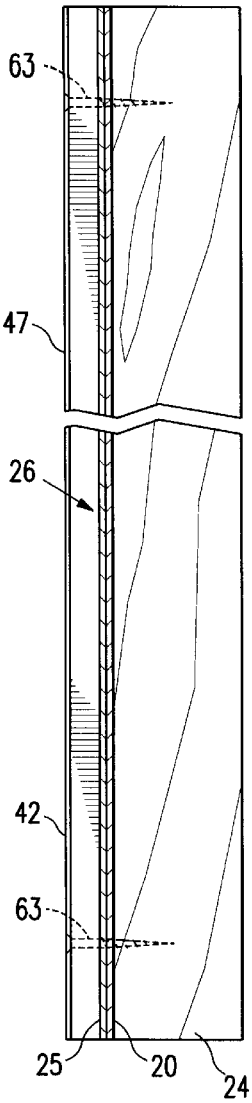
FIG. 6 is a view taken on line 6—6 of FIG. 4.
Figure 5:
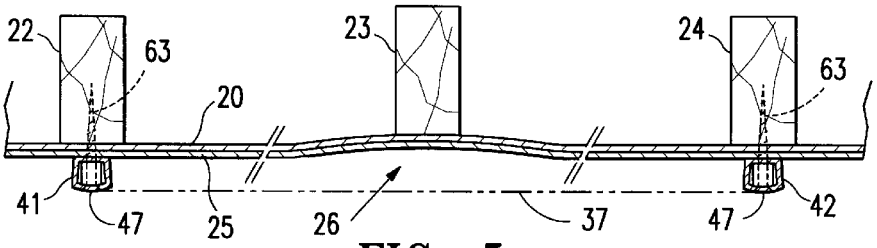
FIG. 5 is a view taken on line 5—5 of FIG. 4.

Turning now to FIGS. 4, 5, and 6, a pair of screeds 41, 42, of the instant invention, are mounted over the apron of the lath 25 and tar paper 20, prior to application of wet mud, and are suitably affixed, FIG. 6, to their corresponding studs 22, 24. It is to be noted in FIG. 4 that the columns 30 of wet mud, which supported the conventional wooden screeds shown in FIGS. 1–3, are not applied to the combination of lath and tar paper in the practice of this invention. Rather, screeds 41, 42 are affixed to the studs while being disposed atop the combination of lath and tar paper, FIGS. 4 and 5.

Figure 7:
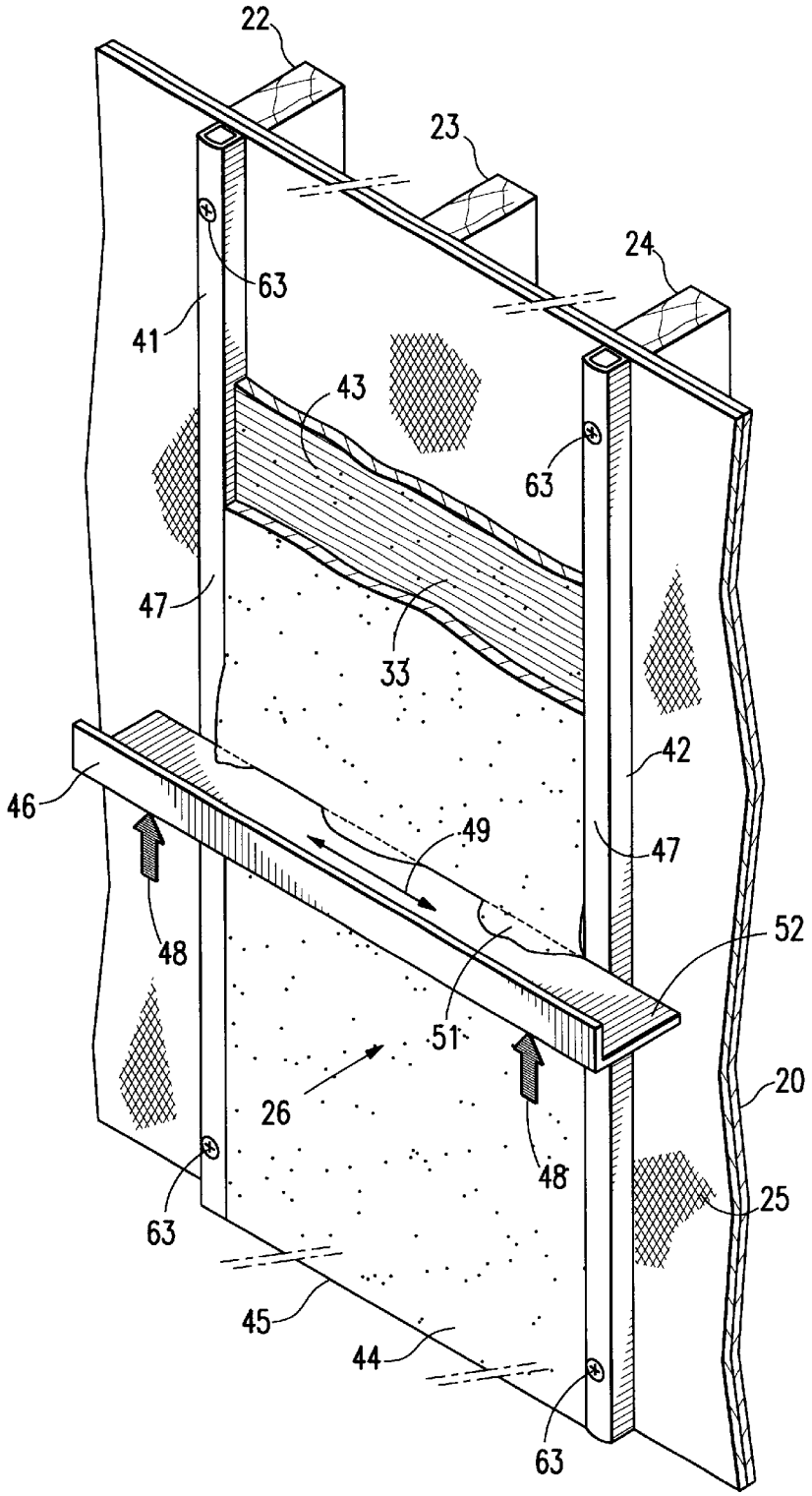
FIG. 7 is a perspective view of an enlargement of FIG. 4, however, showing coatings of mud having been applied between a pair of the inventive devices, and a straight edge tool assisting in producing a planar surface for the wall product being generated.

FIG. 7 illustrates the manner by which both scratch and finish coats 43, 44, respectively, are applied to form a finish wall product, with application of screed devices 41, 42. The scratch coat 43 is applied, beginning at the bottom 45 of the wall product being constructed, in a manual mode similar or like that which would be used in applying wet mud between any two (2) columns 30 illustrated in FIGS. 1–3. It may be noted here that after the first scratch coat drys, cracks may form in it, however, the application of the finish coat 44 fills up these cracks. The first coat 43 is applied or laid between the two screeds 41, 42 and against the combination of lath 25 and tar paper 20 disposed in the apron 26 of space. After coat 43 has dried, the finish coat 44 is similarly applied or set, directly to the first coat 43, between the two screeds 41, 42. A straight edge (tool) 46, FIG. 7, is then manually caused to slidably engage a top surface 47 of each of the screeds 41, 42 and across the deposited second coat 44, to form a finished or smooth surface of the wet mud of material forming the wall product being constructed. The straight edge 46 is manipulated in known fashion, from bottom 45, continually upwardly in the direction of arrows 48 and back and forth in the opposing directions of arrow 49 across the screeds 41, 42. With the illustrated configuration of the straight edge (tool) 46 being used, it may be noted that an excess 51 of the second coat 44 is readily caught behind or on top of a wide but hand-workable slat 52 included along the length of straight edge (tool) 46, accumulating along slat 52 rather than falling into the construction area, thus enhancing, in terms of less time, the laborious effort used in creating the finished wall product and reducing the period of clean-up time necessary to remove the excess from the construction area.

Turning to FIGS. 8–11, each screed 41, 42 of this invention comprises a straight rigid member 54 having a body, preferably as thin as possible or desired, of a suitable or desired length, preferably elongated, in reference to the height or length of the wall product being constructed. Member 54 includes a body formed by opposing side walls 55, 56, a back side 57 joining the two side walls 55, 56 together, and the top surface or front side 47 that is rounded to include an invisible but pronounced tangent line coincident to plane 37, FIG. 5, in practice of the invention while joining the two side walls 55, 56 together and opposing the member's back side 57. The opposing side walls 55, 56 converge towards one another in the direction of back side 57, as illustrated in cross-section in FIGS. 9 and 10, to provide for an easier pull-out of the screed during the mode of operation of generating or building a constructed wall product. Member 54 is shown to be hollow, FIG. 9, however, it may be formed of solid material as well.

Figure 11:
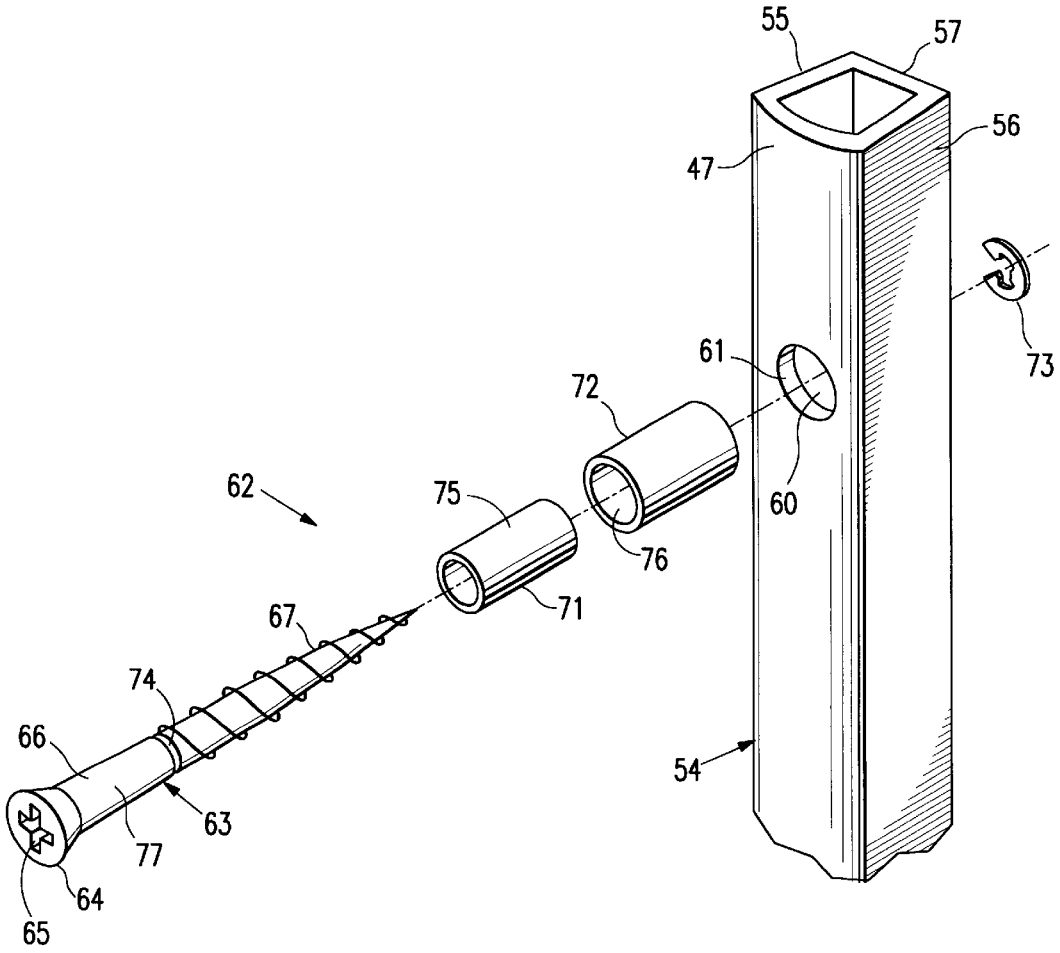
FIG. 11 is a perspective exploded view of an assembly for the screed device of this invention.

At each of two (2) spaced locations along the length of member 54, a bore 60, FIG. 11, is provided, either extending between the front and back sides 47, 57 of a solid material forming member 54, or as shown, by holes 61 forming bore 60 between the front and back sides 47, 57 of a hollow member 54.

An assembly 62 of elements is mounted to member 54 through each bore 60. Assembly 62 comprises a screw 63 having a head 64 with a slot 65 for turning or rotating screw 63, a neck 66 attached to head 64 and which extends in the direction of back side 57, a screw threading portion 67 attached to neck 66 and projecting to beyond the back side 57 of member 54, a pair of bushings or linings or sleeves 71, 72, the one bushing 71 within the other bushing 72, and a lock washer 73 seated or mounted in an annular groove 74 that is situated or formed in neck 66 proximate to or abutting the exterior of back side 57 of member 54 for retaining the assembly 62 in its position in bore 60 of member 54.

The inner bushing 71 is suitably affixed, such as by soldering or welding, to neck 66 of the screw 63, and the outer bushing 72 is suitably affixed to the body formation, either in the holes 61 formed in the sides 47, 57 or throughout solid material of member 54 forming the bore 60, by soldering or welding.

A cylindrical outer surface 75 is included in the inner bushing 71 in order to provide a sliding rotation against a cylindrical inner surface 76 included in the outer bushing 72. This is to be noted because, in the manufacturer of screws, their necks are not necessarily of uniform diameter but tend to taper, as at 77, FIGS. 10, 11, in the direction of the threaded portion 67 of screw 63. Where the neck of the screw does include a uniform diameter throughout its length, along which bushing 71 is situated, thereby producing a true cylindrical geometry, only one bushing would be required, as then the screw's neck 66 would slidably rotate against the internal diameter of the one bushing.

Lock washer 73 seats against the back of the bushings, its diametrical dimension disposed preferably across both the outer and inner bushings, to engage annular groove 74, thereby retaining assembly 62 in its location throughout the depth of member 54. Lock washer 73 is of known type, including a spring-like nature readily turnable or expandable to remove it from groove 74, in the assembling and disassembling of the assembly 62 in member 54. At least a pair of assemblies 62 are spacedly provided at the noted locations along the length of member 54, FIGS. 6, 7.

The top of head 64 of each screw 63 in each assembly 62 lies flush with or behind the top side 47 of member 54 so that the abutting of a straight edge 46 across the pair of screeds 41, 42 in the practice of the invention is not hindered.

Figure 8:
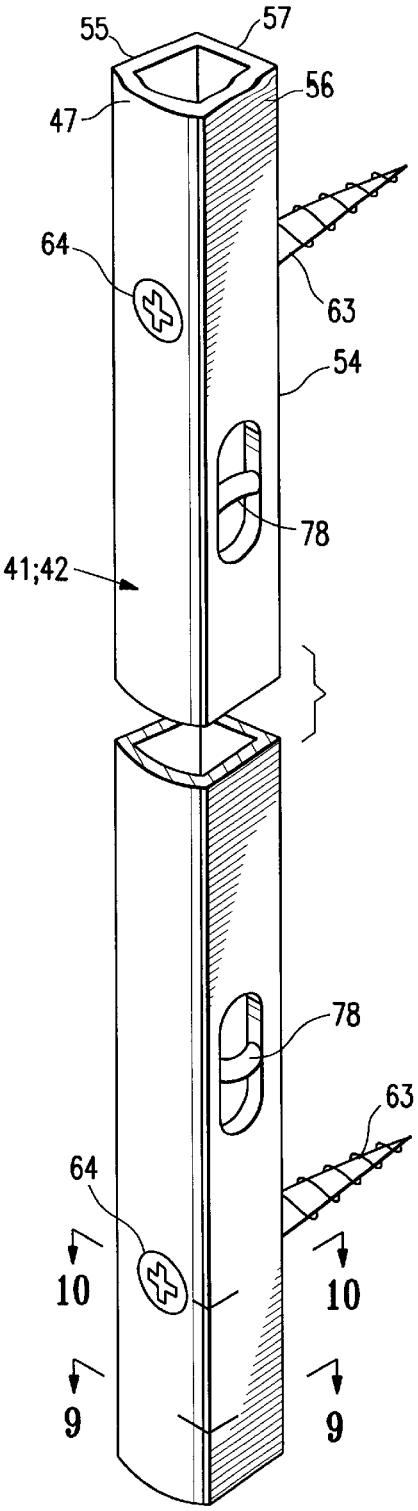
FIG. 8 is a perspective view of the device embodying the instant invention.
Figure 9:
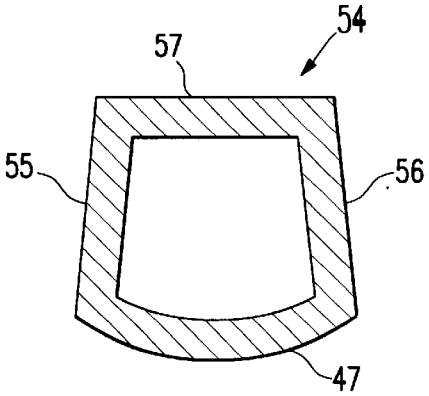
FIG. 9 is a view taken on line 9—9 of FIG. 8.
Figure 10:
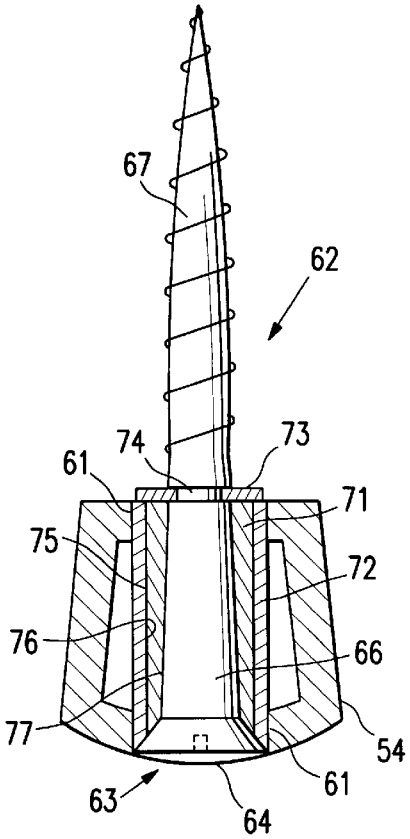
FIG. 10 is a view taken on line 10—10 of FIG. 8.

A pair of levels 78 are incorporated within each screed 41, 42, FIG. 8, in either or both side walls 55, 56, to provide an efficient opportunity to truly plumb the screed in the steps of operation of the invention, although a separate level may be caused to abut either or both sides to effect a true plumb for the screed device.

In operation of the invention, looking to FIGS. 4–7, each of the screeds 41, 42 is mounted atop the lath 25 and tar paper 20, and each is attached to a stud 22, 24, respectively, by means of their corresponding threading portions 67 of screws 63 of assemblies 62, by turning the heads 64. As the devices are screwed to their studs, I. e., adjusting the depths of the screws to their respective studs, levels 78 (or other levels) in their usual employment determines a true plumb for the screed devices along the entire length of the sides' surfaces which is to be produced. The depth of the wall product itself is preliminarily measured, from the lath or tar paper, so that adjusting of the screws 63 is to a point at which the depth of the wall product is not less than what it is supposed to be. Then, a scratch coat 43 is applied or laid across and upwardly of apron 26 of space in known manner and allowed to dry before applying or setting the second or finish coat 44. Even though cracks may appear in the scratch coat after it has dried, the second or finish coat 44 is applied or set in known fashion, between each pair of screeds that have been affixed and plumbed to their corresponding studs. The straight edge 46, FIG. 7, then is applied, in known fashion upon coat 44, prior to its drying, to remove excess 51, if any. A true planar-finished wall surface of mortar or the like between the two screeds 41, 42, results; the wall's surface coinciding or in alignment with the plane 37 formed by the tangential lines or points between the pronounced or rounded front side 47. This coincidence is assured by the screeds' leveling to their studs prior to application of wet muds. With the wall surface of the finish coat 44 formed, and as the wall product is firmed up in an air-drying manner, screeds 41, 42 are removed by unscrewing screws 63 that attach members 54 to their corresponding studs. Thereafter, the gap or void remaining by the removal of each screed 41, 42 is laced with the second or finish coat 44 in accordance with custom of practice.

In another practice of the invention, in the event a tiled facade 80, FIG. 4, is applied to an apron 26 of space on which the invention has been carried out, the advantages of this invention become apparent in the appearance of the facade.

In the assembly of a screed 41, 42, FIG. 11 illustrates an exploded order of elements to be assembled for generating assembly 62. Member 54 has been fabricated with its levels 78 and its bores 60 (or holes 62) formed in it. In a screw 63, its annular groove 74 is formed. The one bushing 71 is affixed to neck 66, while the other bushing 72 is affixed to the body formation either of the holes 62 in or to the member 54. Each screw 63 with its outer bushing 71 is inserted through a bore 60 of the screed and a lock washer 73 is applied to each screw's groove 74 along the back side 57 of member 54.

Member 54 is of solid or tubular nature. Aluminum for it is most useful, as it is light weight in nature and retains its structural rigidity. Other materials, such as other suitable metal, wood or plastic materials, may be utilized for member 54. Bushings, linings, or sleeves 71, 72 are formed of copper or brass, and the screws' material of known and suitable metal. The screed device 41, 42 is suitable and applicable in the formation of ceilings as well as to other angularly-oriented wall product constructions.

Various changes and modifications may be made without changing the spirit or scope of the invention or in any way limit or affect the scope and spirit of the appended claims hereto. One or both side walls 55, 56 need not be converging. The front side 47 of member 54 need not be rounded at its location in its assembly 62, however, the roundness in each member provides for easier coincidence of its line or points of tangency with plane 37 than were the front side 47 itself planar. One bushing, lining, or sleeve, rather than two, can be utilized in the event the screw's neck is of one diameter throughout its length. A change of thickness in the wall of either bushing is not a critical factor. The lock washer can be mounted flush to the back side 57, and other locking mechanisms can be substituted, for example, a pin through the neck. The device is operative without a lock mechanism mounted to it. Two (2) screed devices each with but one (1) screw assembly can be suitably connected together to form a single device. The screed device 41, 42 remains operative were one or more lock washers 73 not included, as a shim(s) could be inserted between stud (or lath) and member 54 during the leveling step while screws 63 are adjusted. The device remains operative also, with only one (1) screw assembly included in the elongated member, as one point of the member can be made stationary, with or without a shim along its length, while the screw assembly elsewhere along the length of member 54 can be adjusted to plumb the device. The screw head 64 is but an illustration of any head member that can turn the threading screwing portion of the device and the head member is not limited to the illustration.

I claim:

1. In a screed device formed by a member having side walls and front and back sides connected together by the side walls, the improvement comprising assembly means rotatably mounted to and extending through the front and back sides of the member for truly plumbing the screed device in the practice of the invention, the adjusting of the assembly means upon its mounting to a static structure producing a true plumb for the screed device, each assembly means comprising means for turning the assembly means disposed at the front one of the sides, means for threading said assembly means to the static structure projecting beyond the back one of the sides, bushing means mounted within the member, the threading means upon actuation of the turning means adjusting the screed device to the true plumb on the static structure in the practice of the invention, and means for locking the assembly means to the member and comprising an annular groove included in the threading means and disposed exteriorly of the back one of said sides and a lock washer seated in the annular groove.

2. In the improvement of claim 1, the front one of the sides being rounded at the location of the assembly means.

3. The improvement of claim 1 wherein the assembly means comprises a plurality thereof spaced apart from each other on the member.

4. The improvement of claim 1 wherein at least one of the side walls converges towards the back one of the sides.

5. The improvement of claim 1 or claim 4 wherein the member includes leveling means in one of its side walls.

6. The improvement of claim 5 wherein said leveling means comprises two levels spaced from one another.

7. The improvement of claim 5 wherein said leveling means comprises a level.

8. In the improvement of claim 1 wherein said threading means comprises a threading portion, said bushing means comprising lining means attached to the member.

9. In the improvement of claim 8, said lining means comprising a sleeve attached to the member, the assembly means rotatable about the member.

10. In the improvement of claim 8 wherein said threading portion includes a neck, said neck including a taper extending towards the threading portion, said lining means comprising a first cylindrically-formed lining attached to the taper of the neck and a second lining attached to the member, the first lining rotatable within the second lining.

11. A screed device comprising a relatively elongated member, freely rotatable screw means mounted to the member and including threaded portions projecting from the member, each screw means including a turning head, a neck secured to the turning head, the threaded portions being secured to the neck, bushing means mounted about the neck and disposed within the elongated member, said bushing means comprising a cylindrically formed lining attached to the neck of the screw, a second lining freely rotatable about the first lining and attached to the elongated member, and means for locking the screw means to the elongated member.

12. The screed device of claim 11 wherein the elongated member includes a rounded front side, the turning head disposed thereat.

13. The screed device of claim 11 or claim 12 wherein the elongated member includes side walls, and means for leveling the elongated member mounted in at least one of the side walls.

14. The screed device of claim 13 wherein the elongated member includes a back side, the screw means includes an annular groove disposed exteriorly of the back side, and the locking means comprises a lock washer seated in the annular groove.

* * * * *